US005160180A

United States Patent [19]

Mlynarczyk

[11] Patent Number: 5,160,180

[45] Date of Patent: Nov. 3, 1992

[54] AUTOMATIC QUICK OPEN/CLOSE LOCKING MECHANISM

[75] Inventor: Mitch Mlynarczyk, Chicago, Ill.

[73] Assignee: Chicago Lock Company, Chicago, Ill.

[21] Appl. No.: 779,513

[22] Filed: Oct. 18, 1991

[51] Int. Cl.[5] ..... E05C 5/04

[52] U.S. Cl. ..... 292/252; 70/208; 411/433; 411/348; 292/58; 292/251

[58] Field of Search ..... 411/348, 433, 267, 266, 411/270; 292/251, 252, 61, 62, 58

[56] References Cited

U.S. PATENT DOCUMENTS

| | | | |
|---|---|---|---|
| 3,477,333 | 11/1969 | Boyd et al. | 411/348 X |
| 4,572,011 | 2/1986 | Mauchlen | 292/252 X |
| 4,647,089 | 3/1987 | Zangrando | 292/252 X |
| 4,927,203 | 5/1990 | Moyer et al. | 292/336.3 |
| 4,974,888 | 12/1990 | Childers | 292/251 |

*Primary Examiner*—Richard E. Moore

*Attorney, Agent, or Firm*—Basil E. Demeur; Robert E. Knechtel; Alan B. Samlan

[57] ABSTRACT

A automatic locking and unlocking device for effecting the locking engagement of a lock stud within a stud receiving fixture. The lock device of the present invention is adapted for locking a movable closure member relative to a stationary member, such as a vending machine door to a cabinet, and provides a quick open and quick close locking feature. The locking device includes a lock stud fitted with a t-handle at its outer end, and a nose portion inner end, the nose portion having a pair of opposed pin engagement ledges formed therein adjacent the nose portion, and provided with male threads positioned adjacent to and forwardly of the pin engagement ledges. The stationary member is provided with a stud receiving lock housing which contains a stationary cam sleeve, a rotatable cam sleeve which reciprocates relative to the stationary cam sleeve, and a coupling which is positioned anteriorly of the rotatable cam sleeve. The coupling includes a plurality of ball bearings which operate to grasp the stud in the locking position by engaging male threads of the stud during the locking procedure. The coupling further includes at least one spring loaded pin which operate to engage the pin engagement ledges of the stud such that upon a quarter turn of the stud, the rotatable cam sleeve will cam away from the stationary cam in order to present a relief area for the ball bearings to exit from the male threads and permit the withdrawal of the lock stud from the lock housing. Biasing means are provided for biasingly urging the rotatable cam sleeve relative to the stationary cam, and the coupling relative to the stationary cam such that the two parts may reciprocate relative to the stationary cam.

19 Claims, 4 Drawing Sheets

AUTOMATIC QUICK OPEN/CLOSE LOCKING MECHANISM

BACKGROUND OF THE INVENTION

The present invention relates to an improvement in pop-out handle locks of the type typically employed in vending machines such as utilized in connection with soda pop vending machines and the like. These types of handle locks permit the operator to insert a key, unlock the lock in order to cause the handle to pop forward, afterwhich the operator may grasp the handle and by rotating the handle in a counterclockwise direction, gain entry to the box of the vending machine.

Handle locks of the pop-out type are well-known, especially in connection with vending machines as mentioned previously. Threadedly locked into position, the handle may be pushed forwardly until it is in its locked position within the confines of a collar. In the past, such handles have attempted to thwart unauthorized entry by eliminating any surface area where an unauthorized person may apply a chisel or other devise for the purpose of exerting force upon the lock in order to gain unauthorized entry. Typically, such types of pop-out handle locks may include a lock mechanism formed by a lock stud which is spring loadedly mounted in the door of the vending machine. The box of the vending machine includes a housing which includes grasping members for grasping the handle lock in order to lock the same, typically consisting of a lock nut held in a cage, such that the lock stud which is threaded, may be screw threadedly engaged into the nut in the housing. Conversions of such types of lock assemblies including for example U.S. Pat. No. 3,089,330, which is directed to a lock assembly for a refrigerated cabinet or other such vending machine, shows the typical pop-out handle lock mechanism having the pop-out handle at the exterior portion of the lock mechanism and the threaded lock stud along the internal portion of the lock mechanism. As is particularly shown in FIG. 2 of the drawings of U.S. Pat. No. 3,089,330, the lock stud is screw threaded into a fixed cage nut incident to the locking process. It will therefore be appreciated that the locking and unlocking process requires that the handle be unlocked in order to pop forward, such that the operator may manipulate the handle in order to rotate the lock stud either in a clockwise direction for locking, or in a counterclockwise direction for unlocking.

Other prior art patents show similar types of pop-out handle lock assemblies, for example, U.S. Pat. No. 3,316,742, which shows another version of a pop-out handle lock which includes an actually movable clutch mechanism allegedly representing an improvement in such lock assemblies, and also as is further shown in U.S. Pat. No. 3,550,412, which again is intended to show certain improvements to such lock mechanisms. However, in each of such prior art instances, the typical pop-out handle lock mechanisms require that the lock stud be screw threadedly engaged into a fixed cage nut in order to lock the same, and require a counterclockwise rotational movement in order to unlock the device.

Further prior art attempts have now been made in order to improve upon such types of pop-out handle lock mechanisms. Principal attempts have been in the area of rendering such locking mechanisms automatic in terms of the locking process. The current example of such types of automatic locking handles as shown in U.S. Pat. No. 4,974,888, wherein the lock stud is similarly provided with a plurality of male threads, while the housing in the cabinet portion of the vending machine is provided with a plurality of grasping members which are spring loaded. We observed that once the lock stud having the male thread portions thereon is inserted into the housing containing the grasping members, the grasping members, which consist of a split nut, are actually moved out of position by the thrust of the lock stud into the housing, and then are spring urged back into grasping position under the threads of the lock stud. The lock stud may then further be rotated in a clockwise direction in order to tighten the door relative to the box of the vending machine in order to improve the seal of the door relative to the cabinet. This is important in such types of vending machines as soda pop machines, or other refrigerated boxes which require a tight seal in order to maintain the integrity of the product contained within the vending machine.

However, it is still deemed necessary to further improve upon such pop-out handle locks for the reason that while attempts are now being made to make such locks automatic in terms of the locking process, it will be observed that in order to unlock the mechanism in order to permit entry into the cabinet of the vending machine, the lock stud must still be rotated in a counterclockwise direction in order to unthread the threads from the grasping members within the housing in order to open the box. Hence, while the lock assembly has been improved in order to render the closing procedure automatic, such improvements have yet to deal with the unlocking process in order to obviate the difficulties of having to rotate the lock stud in a counterclockwise direction for the opening process. It is therefore deemed important to create both an automatic locking procedure for such locking assemblies, as well as an automatic unlocking procedure such that both the locking and unlocking procedures may be rendered automatic. The present invention is therefore intended to further improve upon such pop-out handle lock assemblies by providing a lock mechanism which permits the automatic locking engagement of the lock stud to the lock mechanism thereby eliminating the need for the operator to screw thread the lock stud in a clockwise direction to effect the locking process, and to further provide an automatic unlocking process thereby further eliminating the need for the operator to unthread the lock stud from the lock nut incident to the opening procedure.

OBJECTS AND ADVANTAGES

It is therefore the primary object of the present invention to provide an automatic locking device for pop-out handle lock assemblies, which permits both an automatic locking feature as well as an automatic unlocking feature.

In conjunction with the foregoing object, it is an object of the present invention to provide an automatic locking device for pop-out handle lock assemblies for vending machine type structures which includes a lock mechanism of the type provided with a lock stud mounted in the movable closure member such as a door wherein the lock stud is provided with a series of male threads adjacent to at least a pair of pin engagement ledges formed along the tip end of the lock stud, and wherein the stationary member such as the vending machine box includes a stud receiving locking means mounted therein in substantial linear line-up with the lock mechanism. The stud receiving locking means is provided with a three piece locking device which consists of a stationary cam sleeve which is held in fixed position in the housing and includes a lower cam surface and a pair of stop flanges formed integrally with the stationary cam sleeve and a rotatable cam sleeve which has mating rotating cam surfaces formed along the upper surface thereof. The rotatable cam sleeve further includes at least two differently sized diametric dimensions internally, including a smaller diametric dimension at the forward end of the rotatable cam sleeve and a larger diametric dimension at the rear end of the rotatable cam sleeve and adjacent to where the rotatable cam sleeve will cammingly engage in the stationary cam sleeve. The third locking member consists of a coupling which when elongated includes a forward small throat section which is integrally formed with a larger throat section and a spring seat collar. The small throat portion of the coupling is provided with a series of apertures which entrap radial curved grasping members, which in the preferred embodiment consist of ball bearings, while the spring seat collar is provided with at least a spring loaded pin formed therein and adapted to be normally urged outwardly from the peripheral surface of the collar. The coupling is spring loaded relative to the stationary cam sleeve, and the rotatable cam sleeve is also spring loaded relative to the stationary cam surface.

The object of the present invention is to provide the lock stud having a plurality of male threads spaced somewhat rearwardly of the nose end of the stud such that upon insertion of the lock stud into the coupling portion of the stud receiving mechanism, the ball bearing will abut against the initial threads of the lock stud, and as force is exerted against the lock stud the coupling will be biasingly urged rearward within the confines of the rotatable cam sleeve. The stop ledges on the rotatable cam sleeve abut against stop flanges contained on the stationary cam sleeve, and hence, the only movable part during the locking process will be the coupling. As the coupling is urged rearwardly against the pressure of the spring contained between the coupling and the stationary cam sleeve, the small diametric throat portion of the coupling will be urged rearwardly until the small throat portion is in registry with the larger diametric internal dimension of the rotatable cam sleeve. This area provides a relief area for the balls which may then be pushed upwardly out of the apertures such that the male threads of the lock stud may move forwardly and lodge in any one of the male threads along the length of the lock stud. With pressure on the lock stud, the lock stud will tend to withdraw. The lock stud withdraws until the small diametric throat portion of the coupling is once again in registry with the small diametric internal dimension of the rotatable cam sleeve with the balls arrested in position in one of the threads of the lock stud. Hence, the automatic locking procedure has been accomplished. Further, the lock stud may also be rapidly screw threadedly tightened in order to tighten the seal as between the vending box door and the cabinet as is well-known in the art.

A further object of the present invention, as indicated previously, is to permit an automatic opening feature for such pop-out handle lock assemblies. The automatic opening feature is accomplished by rotating the lock stud in a counterclockwise direction until the spring loaded pins in the coupling engage the pin engagement ledges formed in the lock stud. Due to the configuration of the pin engagement ledges, the lock pins will engage the ledges and stop any further counterclockwise rotation. This action will then prevent the coupling from any further rotational movement and prevents the coupling from backing away from the stationary cam sleeve. However, further rotation of the handle of the lock stud will cause the rotatable cam sleeve to cammingly turn against the cam surface of the stationary cam sleeve, until the small throat portion of the coupling is in registry, once again, with the larger diametric dimension of the rotatable cam sleeve. In such position, the balls have a relief area and they move outwardly from the apertures thereby releasing the grasp of the male threads formed on the lock stud. In that position, the lock stud may be withdrawn from the stud lock receiving mechanism in order to achieve a quick open. Once the lock stud is removed from the unit, the rotatable cam sleeve will return to its normal rest position as a result of the force supplied by the sleeve spring interposed between the rotatable cam sleeve in the housing.

Futher objects and advantages of the present invention will be better understood in reference to the accompanying drawings and specification in accordance with the description set forth hereinafter.

BRIEF SUMMARY OF THE INVENTION

In summary, the present invention provides a pop-out handle lock assembly which represents an improvement over prior art such types of locks in that the present invention permits not only an automatic quick lock device, but also permits an automatic quick open procedure for unlocking the handle lock incident to the opening process. The present invention therefore permits an operator to quickly lock the vending machine by forcing the door against the cabinet such that the lock stud of the lock assembly enters the lock housing contained within the housing until the grasping lock mechanism contained within the housing grasps the male threads of the lock stud. In addition, due to the construction of the grasping lock mechanism as relative to the lock stud, the construction is such that it allows further rotation of the lock stud relative to the lock mechanism so that the entire lock mechanism may be screw threadedly tightened in order to further improve the seal as between the cabinet door and cabinet. The unlocking procedure is similarly a quick open procedure in that means of a quarter counterclockwise turn of the lock stud, the lock mechanism is caused to internally cam, one member against the other, until the grasping means consisting of the ball bearings ride out of engagement with the male threads until they reach position where the lock stud may be quickly withdrawn from the lock housing to prevent a quick open feature for such lock assembly. The lock mechanism of the present invention further includes a fail-safe system in that should the lock mechanism fail for any reason and not permit the quick open portion of the lock mechanism to operate properly, the lock stud may be rotated in a counterclockwise direction. Since the ball bearings are helically displaced, the same act as threads relative to the male threads of the lock stud and therefore permits the screw threading and unthreading of the lock stud relative to the lock mechanism.

Heretofore, such pop-out handles have not acquired the features of both a quick lock as well as a quick open procedure, and hence, the present invention represents improvement in such lock assemblies.

DETAILED DESCRIPTION OF DRAWINGS

Figure 1:
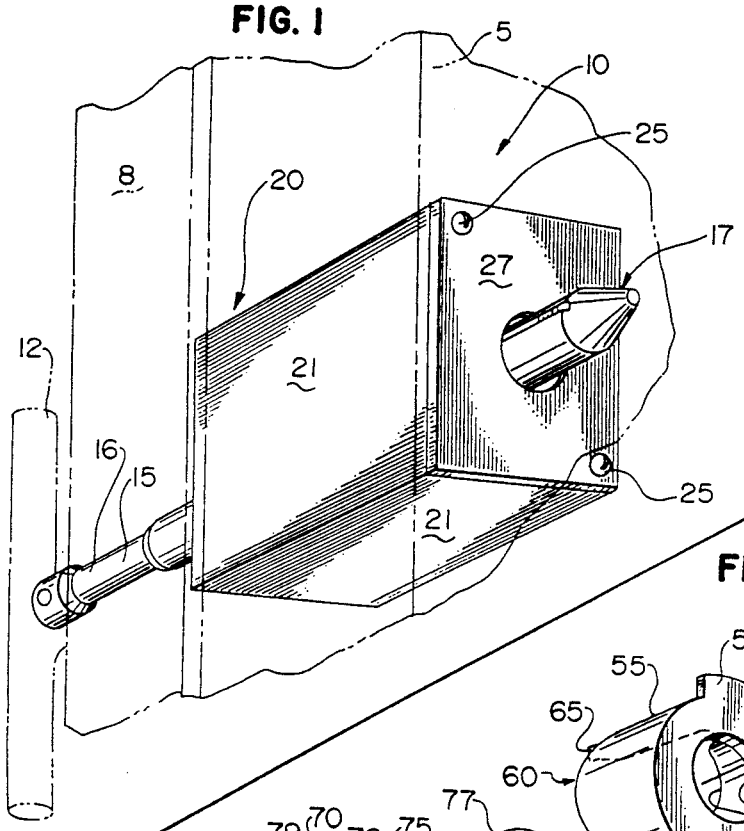
FIG. 1 is a perspective view showing the pop-out handle lock assembly of the present invention with the handle lock stud mounted on the door of a cabinet, and the housing mounted in the interior portion of the cabinet.

FIG. 1 of the drawings illustrates the pop-out handle lock assembly of the present invention as mounted in a typical vending machine. The typical vending machine in conjunction with which the present lock is employed generally consists of a cabinet 5 in which is contained the product to be vended, and a door 8 which movably encloses the cabinet 5. The lock assembly is generally denoted by the numeral 10, and shown to include a pop-out handle 12 which is fastened to a lock stud 15 in any suitable manner such as by a pin 13. For purposes of the foregoing description, the lock stud 15 will be referred as having an anterior end which is the end to which the handle 12 is attached, and a posterior end which is adapted for insertion into the lock assembly in a manner which will be further explained hereinafter. The anterior end will be referred to by the numeral 16, and the posterior end by the numeral 17.

As generally illustrated in FIG. 1, the lock stud 15 lockingly engages the door 8 to the cabinet 5 by entering into the lock housing generally denoted by the numeral 20. Again as shown in FIG. 1, the lock housing 20 is fixedly secured in the side of the cabinet 5, while the lock stud 15 and associated handle 12 are secured to the door 8 of the vending machine as illustrated. It will be appreciated that the locking and unlocking of the vending machine occurs when the lock stud 15 is inserted within the housing 20 and are lockingly engaged therein thereby locking the door 8 with respect to the cabinet 5. This procedure is well-known in the prior art.

Figure 2:
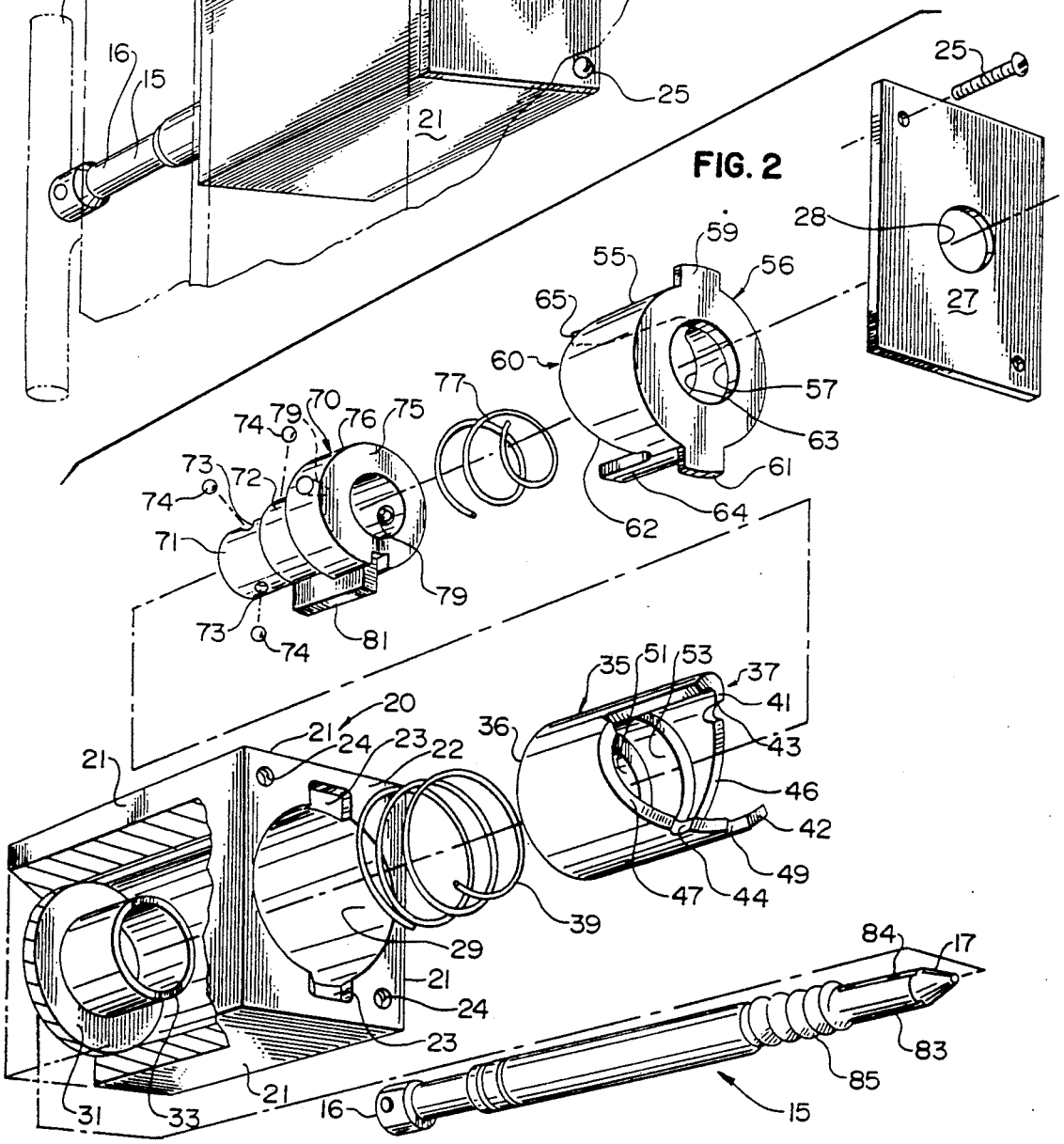
FIG. 2 is an exploded view showing the details of the construction of the grasping lock mechanism contained within the lock housing, and a perspective view of the lock stud as the same may be inserted within the confines of the housing.

FIG. 2 is an exploded view showing the various elements comprising the lock mechanism for lockingly engaging the lock stud 15 within the confines of the housing 20. It is contemplated that the lock housing 20 will be formed by a series of four side walls, each referred to by the numeral 21 and bounded in front by a front wall (not shown) which has an appropriate centrally disposed lock stud aperture formed therein. The rear wall of the housing has an enlarged aperture which accommodates the assembly of the grasping portions of the lock mechanism therein. The rear wall 22 is shown to include a pair of opposed seatment slots 23 for a purpose to be described hereinafter, and also a pair of opposed threaded apertures 24 which accommodate the threading engagement of screws 25 for lockingly engaging a back plate 27 against the rear wall 22 of the housing 20. Obviously, any locking means may be employed to lock the back plate onto the housing, such as for example, rivets, or other fastening means. The mounting of the back plate 27 to the housing 20 is not considered to be particularly pertinent with respect to the present invention. The back plate 27 is also appropriately centrally apertured as illustrated at 28 in order to accommodate the passage there through of the posterior end 17 of the lock stud 15 (see FIG. 1). It will be noted that the housing 20 is formed such that the side walls 21, front wall and rear wall 22 create a lock chamber 29 in which the lock stud grasping mechanism is contained. Further, the lock chamber 29 is shown to include a sleeve spring seat collar 31 which surround an anteriorly extending coupling stop ledge 33, extending anteriorly into the lock chamber 29 for a distance, and for a purpose to be described more fully hereinafter.

The locking mechanism is generally formed from three basic elements which include a rotatable cam sleeve 35 which is generally circular in configuration, as illustrated in FIG. 2. The rotatable cam sleeve 35 includes an anterior end 36 and a posterior end 37. The anterior end 36 of the cam sleeve 35 forms a spring seatment ledge 38 (see FIG. 3) and therefore accommodates a sleeve spring 39 which is interposed between the rotatable cam sleeve 35 and the spring collar 31. The posterior end 37 of the rotatable cam sleeve 35 is formed into a pair of opposed rotating cam ledges 41 and 42 respectively. Each rotating cam ledge 41 and 42 terminates at a stop ledge 43 and 44 respectively. It will also be noted that the opposed upper side walls adjacent the posterior end 37 of the rotatable cam sleeve 35 are cut away thereby to provide opposed relief slots 46 and 47 respectively. An alignment slot 49 is formed along the horizontal axis portion of the side wall of the rotating cam sleeve 35 as illustrated in FIG. 2.

It will also be observed that the rotating cam sleeve 35, in the preferred embodiment, is shown to be tubular in configuration being open along the interior confines thereof. Further, as illustrated in FIG. 2, the anterior end 36 of the cam sleeve 35 as the smallest internal diametric dimension and therefore forms a containment chamber 51 for a purpose to be described hereinafter. Above the containment chamber 51 is a relief chamber 53 which is formed for a purpose, again to be described more fully hereinafter. As viewed in FIG. 2 of the drawings, the rotatable cam sleeve 35 is designed to seat immediately posterior of the front wall of the housing 20 and is normally biasingly urged posteriorly by means of the sleeve spring 39 (see FIG. 3).

As further illustrated in FIGS. 2 through 5 of the drawings, positioned immediately posteriorly of the rotatable cam sleeve 35 is a stationary tubular cam sleeve 55 which is of generally the same overall diametric dimensions as the rotatable cam sleeve 35. The posterior end 56 of the stationary cam sleeve 55 forms a spring seatment surface 57 (see FIG. 3), and it will be observed that the posterior end 56 of the stationary cam sleeve 55 is apertured as illustrated at 58 in order to accommodate the insertion and passage there through of the lock stud 15. It will also be observed that the posterior end of the stationary cam sleeve 55 includes a pair of opposed seating tabs 59 and 61 respectively, which, when assembled are designed to seat within the seatment slots 23 formed in the rear wall 22 of the lock housing 20. In this manner, the stationary cam sleeve 55 will in fact remain stationary during the operational movements of the lock mechanism.

The anterior end 60 of the stationary cam sleeve 55 is shown to be formed by a pair of opposed cam surfaces 62 and 63 respectively, which, in operation will ride on the cam ledges 41 and 42 respectively of the rotating cam sleeve 35. Each of the cam surfaces 62 and 63 respectively terminate in opposed stop flanges 64 and 65 which, in operation, will form stop positions when the stop ledges 43 and 44 respectively of the rotating cam sleeve 35 abut there against.

The lock mechanism contained within the housing 20 is completed by means of an intermediary member consisting of a coupling 70 which is basically tubular in configuration, and is formed by a small throat section 71 anteriorly positioned, and a larger throat section 72 posteriorly from the small throat section 71. The small throat section 71 includes a series of three radially disposed and displaced apertures (each referred to by the numeral 73) each of which contains a ball bearing 74 therein. The posterior end of the tubular coupling 70 is formed by a spring flange surface 75 which accommodates the seatment there against of a coupling spring 77 which is interposed between the spring flange surface 75, and the spring seatment surface 57 of the stationary cam sleeve 55 (see FIG. 3 and 4). The posterior end 76 of the coupling 70 includes a pair of spring loaded pins 79 which are, in the normal operating position, biasingly urged outwardly and extending outwardly from the peripheral surface of the sides of the posterior end 76 of the coupling 70. The spring loaded pin 79 operates in conjunction with the lock stud 15 in a manner which will be described hereinafter. It will also be observed that the coupling 70 includes an alignment flange 81 which, when the lock mechanism is assembled, slides into the alignment slot 49 of the rotatable cam sleeve 35. Hence, the coupling 70 and rotatable cam sleeve 35 are kept in alignment during all operating features of the lock mechanism.

Again with reference to FIG. 2 of the drawings, the lock stud 15 is shown to have a horizontal axis, with anterior end 16 to which the handle 12 is attached as previously described, and a posterior end 17, which is formed as a nose portion and is the end of the lock stud 15 which enters into the lock mechanism, all is as commonly known with respect to the prior art. The lock stud 15 is generally formed of a hard steel material, although any material as may be desired may be employed. Structurally, the lock stud is shown to have a pair of opposed pin engagement ledges 83 and 84 respectively positioned on radially opposed side edges of the lock stud 15. Each pin engagement ledge 83 and 84 respectively will in one operational feature engage with the spring loaded pins 79 within the coupling 70. Structurally, by camming the upper surfaces of the pin engagement ledges 83 and 84, the lock stud 15 may be rotated clockwise and in such rotational posture the spring loaded pins 79 will ride over the cam surfaces of the pin engagement ledges 83 and 84 without locking in position. However, the counterclockwise rotation of the lock stud 15 will cause the spring loaded pins 79 to engage against the pin engagement ledges 83 and 84 respectively, and will therefore lock the lock stud 15 with respect to the coupling 70. This feature structurally impacts upon the quick open functions of the present lock assembly. The lock stud 15 is completed by means of a series of male threads 85 which are formed immediately anteriorly of the opposed pin engagement ledges 83 and 84 respectively.

It is also apparent from the description of the present invention that the apertures formed in the smaller diametric throat portion of the coupling are arranged in a radially displaced as well as helically oriented disposition such that the balls contained therein, will also assume a helically displaced orientation. This construction will operate in conjunction with the male threads of the lock stud to permit both the screw threading and unthreading of the lock stud relative to the coupling. Hence, should the.operator of the unit desire to further tighten down the seal of the door relative to the cabinet, the lock stud may be screw threaded in a clockwise direction in order to enhance or improve the seal as between the door and the cabinet. Similarly, in the event that the lock mechanism should fail for any reason, and the quick open feature not operate properly, such as for example, the spring loaded pins break and do not engage the pin engagement ledges on the lock stud, the lock stud may be rotated in a counterclockwise direction and will unscrew relative to the coupling in order to open the unit. Hence, a fail-safe system is built into the present invention.

Having now described the structure of the lock mechanism and the lock stud, the operational features of the lock mechanism will be described with respect to the movement of the parts and elements during the locking and unlocking phases of the lock mechanism.

Having described all of the parts and elements of the locking mechanism, the remaining figures illustrate sequentially, the manner in which the locking mechanism will engage for the locking procedure, and will quickly disengage to accomplish the unlocking procedure. Hence, FIGS. 3, 4, and 5 of the drawings show the locking stages for lockingly engaging the lock stud within the confines of the lock mechanism, and FIGS. 6, 7, and 8 of the drawings illustrate the initial stages and sequential steps of the unlocking procedure.

Figure 3:
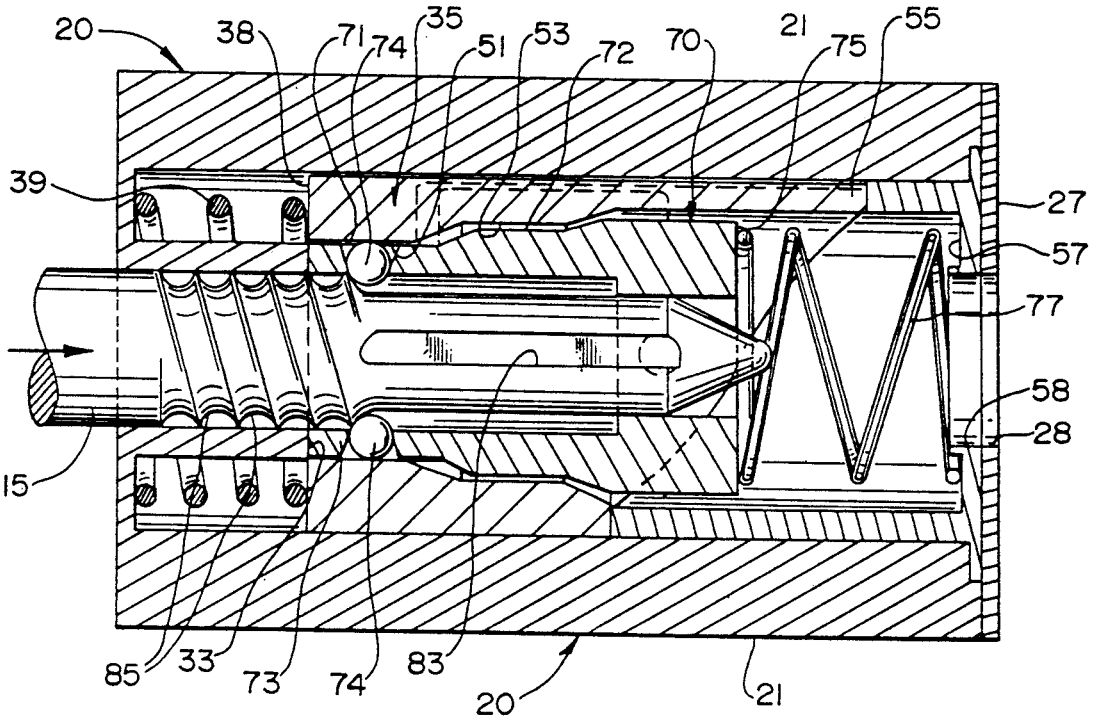
FIG. 3 is a side elevational view, in cross section, showing the initial entry position of the lock stud incident to the locking process manner in which the various lock mechanisms will operate in order to lock the lock stud in position.
Figure 4:
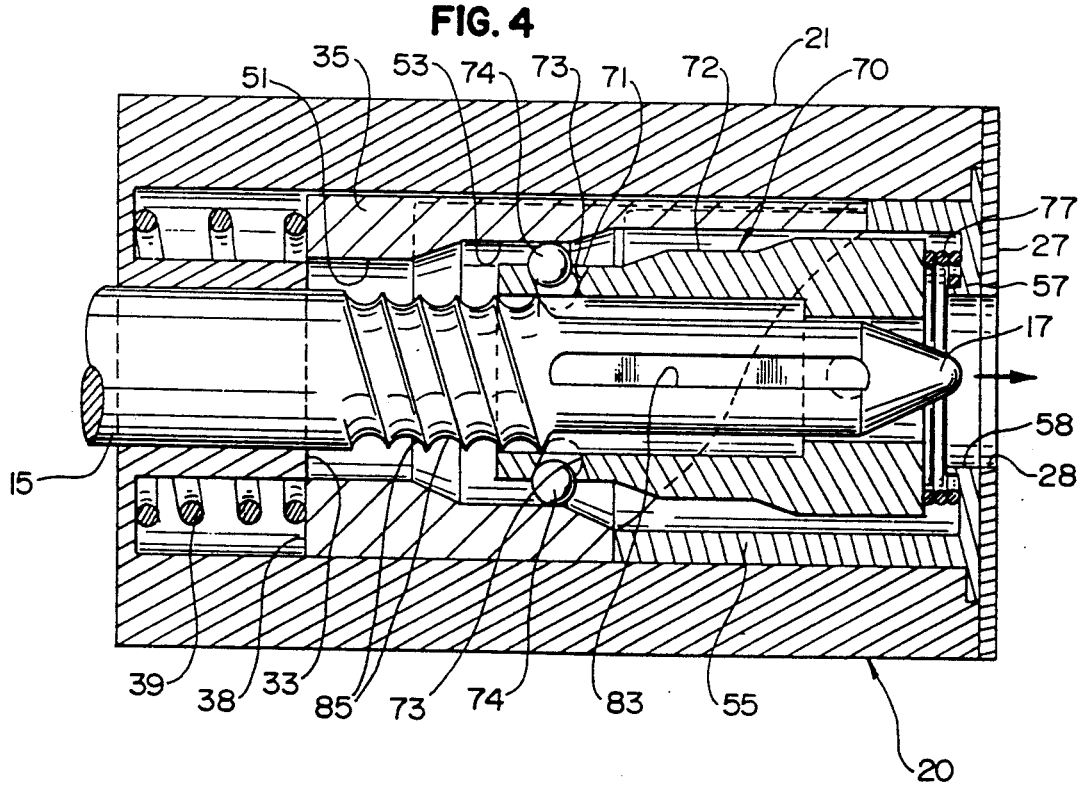
FIG. 4 is a side elevational view, in cross section, showing an intermediate locking position wherein the ball bearings are in order to gain entry into the male threads of the lock stud incident to the locking process.
Figure 5:
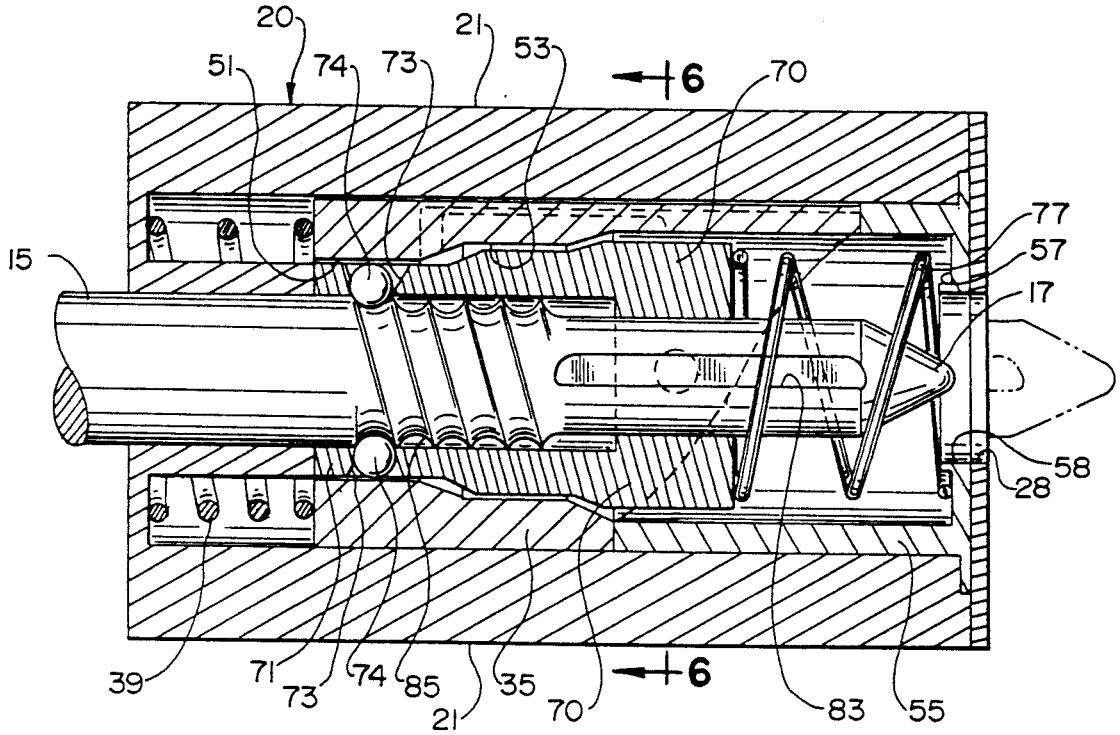
FIG. 5 is a side elevational view in cross section, showing the locking process as completed, with the ball bearings arrested within the confines of the male threads of the lock stud and in the confinement area of the rotatable cam sleeve.

With specific reference to FIGS. 3 through 5 of the drawings, and with particular reference to FIG. 3, it will be observed that in this figure the lock stud 15 has now been inserted into the housing 20, and hence, enters into the lock mechanism via the coupling 70. As indicated previously, the coupling includes a plurality of ball bearings 74 which are positioned in ball apertures 73 formed in the coupling 70. As shown in FIG. 3, when the male threads 85 of the lock stud 15 confront the balls 74, the balls 74 will abut the first threads 85 as confronted. It will be observed that in this position, the coupling 70 is positioned such that the small throat section 71 is positioned adjacent to the containment chamber 51 forming the smallest diametric dimension 51 of the rotatable cam sleeve 35. As force is continually applied to the lock stud 15, the abutment of the male threads 85 against the ball 74 will force the coupling 70 to move posteriorly against the pressure of spring 77, such that the coupling 70 moves rearwardly relative to the rotatable cam sleeve 35 as well as the stationary cam sleeve 55. The rotatable cam sleeve 35 is prevented from any posterior recriprocating motion due to the fact that it is abutted up against the stationary cam sleeve 55.

FIG. 4 illustrates the next position of the lock stud 15, and the corresponding coupling 70 as the same is pushed posteriorly relative to the rotatable cam sleeve 35. It will be observed that once the small throat section 71 of the coupling 70 has moved forwardly and has confronted the larger diametric dimension of the large throat section 72, the balls 74 are permitted to move away from the male threads 85 since the larger diametric dimension of the relief chamber 53 is now confronted. In this position, the male threads are permitted to pass beyond the position of the ball apertures 73 hence permitting at least some of the male threads 85 to pass the ball apertures 73. The coupling 70 will ultimately come to rest at the posterior end of the housing in the position as illustrated in FIG. 4. It will also be appreciated that the lock stud 15 may be moved forwardly since the stationary cam sleeve 55 as well as the back plate 27 are apertured in order to permit the lock stud 15 to pass there through.

FIG. 5 of the drawings illustrates the completion of the locking procedure. In this position, the balls 74 have dropped into the male thread 85 of the lock stud 15 and due to the biasing force of the coupling spring 77, coupling 70 will be pushed rearwardly once pressure is removed from the lock stud 15. Hence, as the lock stud 15 backs away toward the anterior portion of the housing, the balls 74 which have now entered the male thread 85 of lock stud 15 will arrest and capture the lock stud 15 in its locked position. It will be observed that the small throat section 71 of the coupling 70 has once again reciprocated anteriorly toward the anterior end of the lock housing 20 such that the balls 74 are captured and arrested in the male threads 85. It will therefore be appreciated that as a result of the lock stud 15 being inserted into the housing 20 through the coupling 70 and the coupling 70 reciprocated posteriorly until the balls have retracted upwardly and then retreated and arrested the lock stud 15 as illustrated in FIG. 5. It will be noted that in the fully locked position, the coupling 70 once again rests and abuts against the coupling stop ledge 33 as was in its starting position illustrated in FIG. 3. In this connection, FIG. 4 clearly illustrates that when the coupling 70 is pushed forward since the ball bearings 74 have abutted against the male threads 85, the coupling 70 will in fact reciprocate posteriorly against the force of the coupling spring 77.

Figure 6:
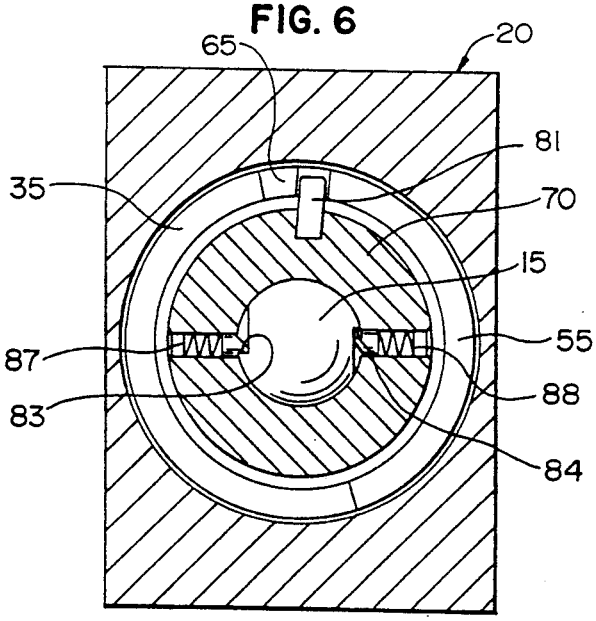
FIG. 6 is a cross sectional view taken in the direction of the arrows along line 6—6 of FIG. 5, showing the relative position of the housing, stationary cam sleeve, rotatable cam sleeve, coupling, and lock stud, incident to the initiation of the quick open procedure, and also shows pin engagement lock means relative to the lock stud.
Figure 7:
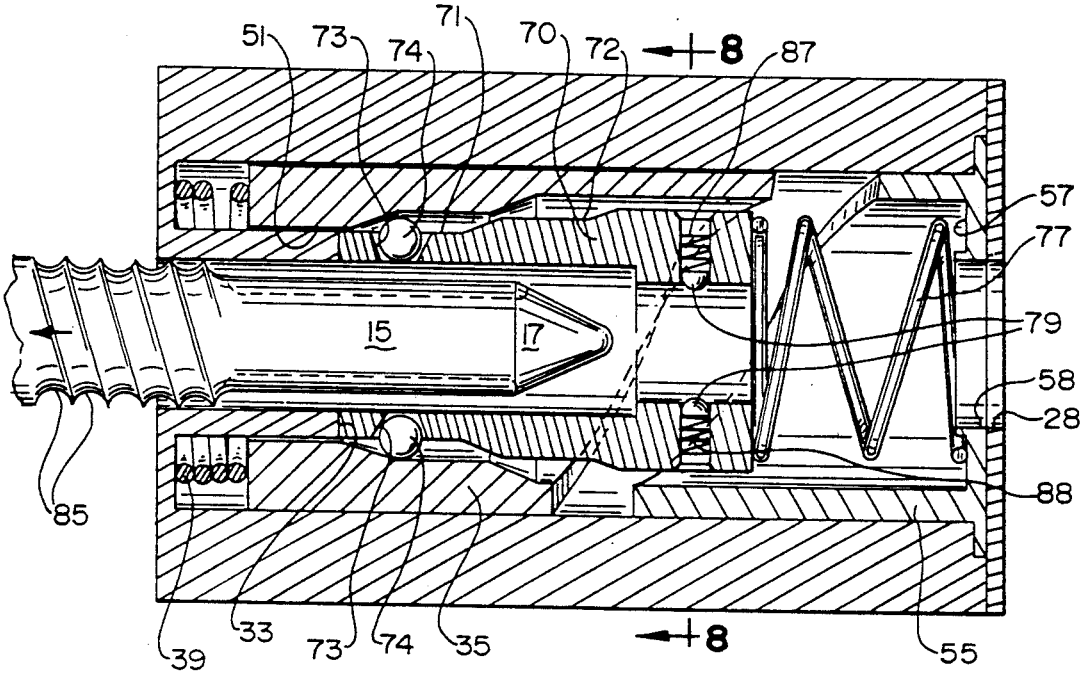
FIG. 7 is a side elevational view, in cross section, showing the lock stud being withdrawn from the housing assembly incident to the quick unlock procedure of the lock assembly of the present invention.

FIG. 6 illustrates the beginning stages of the quick open procedure of the present invention. As shown in FIG. 6, the lock stud 15 has been rotated counterclockwise and it will be observed that the spring loaded pins which are urged inwardly toward the anterior confines of the coupling 70 by means of springs 87 and 88, have now engaged the pin engagement ledges 83 and 84 respectively located on opposed sides of the lock stud 15. FIG. 6 also illustrates the cam construction of the pin engagement ledges 83 and 84. It will be appreciated that a clockwise rotation of the lock stud 15 will simply cause the spring loaded pins 79 to ride over the surface of the lock stud 15 as well as over the pin engagement ledges 83 and 84 respectively. However, a counterclockwise rotation of the lock stud 15 will cause the pins to engage against the pin engagement ledges 83 and 84 respectively and lock into position. It will be appreciated that as one views FIG. 6 of the drawings, however, one is viewing clockwise as well as counterclockwise rotation in a mirror image fashion, and hence, as viewed in FIG. 6, one is viewing the relative movement of the parts from the posterior end of the lock mechanism. Hence, as the operator continues to attempt to rotate the handle 12 and therefore the lock stud 15 in a counterclockwise direction, the coupling 70 is prevented from reciprocating movement toward the anterior portion of the lock housing. It is now abutting against the coupling stop ledge 33 formed in the anterior portion of the lock housing 20 and will not reciprocate any further. However, the rotatable cam sleeve 35 will have a camming action since the rotating cam ledges 41 and 42 respectively will cam along the cam surfaces 62 and 63 respectively of the stationary cam sleeve 55. Hence, as the rotatable cam sleeve 35 rotates, such that the rotating cam ledges 41 and 42 cam along the cam surfaces 62 and 63 of the stationary cam sleeve 55, the rotatable cam sleeve 35 will move anteriorly within the lock mechanism and assume the position as shown in FIG. 7. As illustrated therein, the coupling 70 remains in position abutted against the coupling stop ledge 33, and the stationary cam sleeve 55 remains in position, the only part being rotated and reciprocating is the rotatable cam sleeve 35. In this posture, it will be observed that the rotatable cam sleeve 35 has moved relative to the coupling 70 such that, once again, the balls will move from the containment chamber 51 of the rotatable cam sleeve 35 to the relief chamber 53 forming the larger diametric dimension within the confines of the rotatable cam sleeve 55. Hence, the balls 74 may now move out of locking position with respect to the male threads 85 of the lock stud 15, and in this position, and as shown in FIG. 7, the lock stud 15 may be easily withdrawn from the lock mechanism. It will also be observed that the reciprocating movement of the rotatable cam sleeve 35 has operated against the pressure of the sleeve spring 39 and hence, as soon as the lock stud 15 is withdrawn, the spring 39 will urge the rotatable cam sleeve posteriorly toward the stationary cam sleeve 55 and reset the lock mechanism as previously described. In its reset position, the small throat section of the coupling 70 is in alignment, once again, with the containment chamber 51 of a rotatable cam sleeve, with the balls 74 forced, once again, in this position the lock mechanism is once again ready for the locking procedure as previously described.

Figure 8:
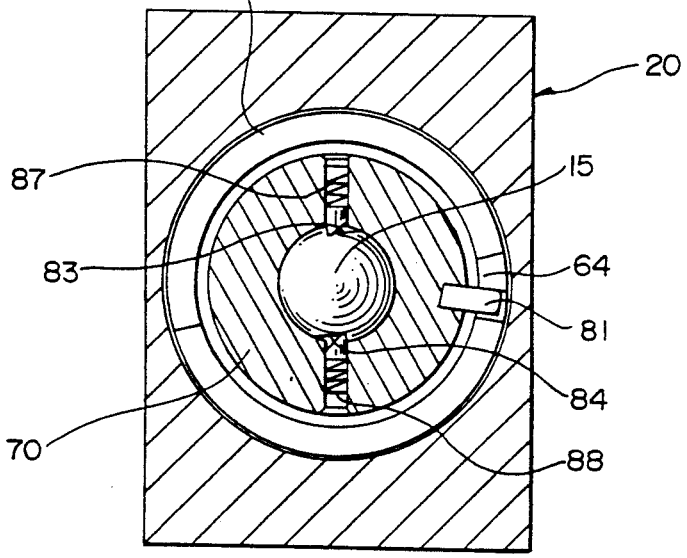
FIG. 8 is a cross sectional view taken in the direction of the arrows along the line 8—8 of FIG. 7, showing the position of the lock stud relative to the coupling during the withdrawal of the lock stud from the lock housing.

Comparing FIGS. 6 and 8 of the drawings, it will be appreciated that the rotatable cam sleeve has been rotated from a first position wherein the stop ledge has moved from a point adjacent to the stop flange 65 (FIG. 6) to a position to where it is in abutting engagement against stop flange 64.

It will be appreciated from the above description that the present invention provides both a quick open as well as a quick lock locking mechanism for pop-out handles. As described, the locking procedure is easily accomplished by simply pushing the door of the vending machine closed and pushing on the handle 12 of the lock stud 15 until the same enters into the lock housing 20 and enters into the coupling 70. As previously indicated, this action will force the coupling 70 to move posteriorly until the coupling 70 moves into the relief chamber 53 of the rotatable cam sleeve 35. In this position, ball bearings 74 are permitted to move out of the ball apertures 73 permitting the male threads 85 of the lock stud 15 to pass the ball apertures 74. Once pressure is released from the lock stud 15, and as the lock stud withdraws anteriorly due to the biasing pressure of the coupling spring 77, the balls 74 will fall into the male threads 85 and arrest the lock stud 15 into its locked position. Since the balls travel back into the confinement chamber 51, lock stud 15 is securely locked into position.

It will be appreciated that the quick open feature is accomplished because the coupling 70 as well as the stationary cam sleeve 55 will remain in position when the lock stud 15 is rotated in a counterclockwise direction. As illustrated and previously described, the spring loaded pins 79 formed in the coupling 70 engage the pin engagement ledges 83 and 84 of the lock stud 15 cammed against the cam surfaces of the stationary cam sleeve 55 and will reciprocate the rotatable cam sleeve 35 relative to the coupling 70. As that action occurs, the small throat section 71 of the coupling 70 will come into alignment with the relief chamber 53 of the rotatable cam sleeve 35 until the balls are permitted to drop away from the apertures 73 and release the lock stud 15.

It will be appreciated from the above description that pursuant to the present invention, all of the objects and advantages as set forth above have been achieved. Hence, a pop-out handle lock assembly of the type described has now been developed which permits not only a quick close feature, but a quick open feature as well. Furthermore, it will be appreciated that the quick open and quick lock features have been accomplished with a minimum of moving parts in that the entire lock mechanism basically includes only two moving parts, that is the rotatable cam sleeve as well as the coupling, thereby to minimize difficulties with the mechanism in the field. Furthermore, by providing ball bearings as the grasping members, longer life expectancy of the lock mechanism is achieved since it is quite well-known that ball bearings have a relatively long life because of de minimal friction which occurs during each manipulation of the lock mechanism.

It will therefore be appreciated that all of the objects and advantages of the present invention have been achieved and a significant improvement has been developed with respect to handle lock assemblies of the type commonly used in vending machines.

While there has been described what is at present considered to be the preferred embodiments of the invention, it will be understood that various modifications may be made therein and it is intended to cover in the appended claims all such modifications as followed in the true spirit and scope of the invention.

I claim:

1. The locking device for automatically locking a movable closure member relative to a stationary member such as a vending machine door and cabinet respectively, comprising;

a lock mechanism of the type provided with a lock stud having a horizontal axis mounted on the movable closure member, said lock stud having an anterior end and a posterior end, and having a lock handle secured thereto at the anterior end, and the posterior end formed into a nose portion, said lock stud provided with a series of male threads formed in said lock stud adjacent to and along the posterior end thereof and provided with disengagable lock engaging means formed in said lock stud posteriorly of said male threads and anteriorly of said nose portion, stud receiving locking means mounted on the stationary member, said stud receiving locking means formed by a housing which accommodates the insertion therethrough of said lock stud, said housing including a first rotatable tubular sleeve member having an anterior end and a posterior end and having a reduced diametric interior adjacent the anterior end and an expanded diametric interior adjacent the posterior end thereof, said posterior end having at least one cammed surface formed along the posterior surface thereof, a tubular coupling member having an anterior end and a posterior end and seated within said first rotatable tubular sleeve member, said coupling member having a reduced diametric throat portion adjacent the anterior end thereof and a larger diametric throat portion adjacent the posterior end thereof, said reduced diametric throat portion having at least one aperture formed therein and said larger diametric throat portion provided with disengagable lock means carried thereon, at least one radially curved grasping element seated within the confines of said aperture in said reduced diametric throat portion of said coupling, said coupling member seated within said first rotatable tubular sleeve member such that said reduced diametric throat portion thereof is positioned in radial alignment with said reduced diametric anterior end of said first rotatable tubular sleeve member, and said larger diametric throat portion is in radial alignment with said expanded diametric throat portion of said first rotatable tubular sleeve member when said respective members are in the rest position, a second stationary tubular sleeve member seated adjacent said first rotatable tubular sleeve member and in horizontal alignment therewith adjacent the posterior end thereof, having an inner lip end and an upper spring seat surface, said second stationary tubular sleeve member having at least one stationary cam surface formed along said inner lip end for cammingly engaging said cammed surface formed along the posterior end of said first rotatable tubular sleeve member, said second stationary tubular sleeve member being stationary relative to said housing and said first rotatable tubular sleeve member being rotatable relative to said second tubular sleeve member along the cam surfaces thereof, biasing means interposed between said first rotatable tubular sleeve member and said housing, and coupling biasing means interposed between said coupling and said upper spring seat surface of said second stationary tubular sleeve member such that said first and second tubular sleeve members are normally biasingly urged together and said coupling is normally biasingly urged away from said second tubular sleeve member, said first rotatable sleeve member, coupling and second stationary tubular sleeve member being adapted to accommodate the insertion therethrough of said lock stud, whereby upon insertion of said lock stud into said housing, said male threads thereof will confront said radially curved grasping element carried by said coupling and biasingly urge said coupling posteriorly until said radially curved grasping element is permitted to reciprocate upwardly through said aperture containing same when said reduced throat portion of said coupling is in registry and alignment with said expanded diametric interior of said first tubular sleeve member, and allows said radially curved grasping element to ride into one of the male threads of said lock stud such that upon release of said lock stud, said grasping element retracts once again into said aperture when entering said reduced diametric anterior of said first tubular sleeve member thereby to lock said lock stud within said housing; and the opening of the lock mechanism is accomplished by rotating said lock stud counterclockwise until said disengagable lock engaging means engage the disengagable lock means carried in the posterior end of said coupling thereby to permit rotation only in a counterclockwise direction and thereby to permit only the rotation of said first tubular sleeve member to cam anteriorly relative to said second tubular sleeve member until the radially curved grasping element rides into the expanded throat portion thereof and out of contact with said male threads of said lock stud permitting said lock stud to be fully withdrawn from said lock stud receiving mechanism and allow opening of the movable closure member relative to the stationary member.

2. The locking device as set forth in claim 1 above, wherein said male threads formed on said lock stud are positioned anteriorly of said disengagable lock engaging means and said nose portion.

3. The lock mechanism as set forth in claim 2 above, wherein said disengagable lock engaging means comprises a pair of pin engagement ledges formed in said lock stud, said pin engagement ledges extending along the horizontal axis of said lock stud and said pair of pin engagement ledges being radially spaced apart one from the other.

4. The lock mechanism as set forth in claim 3 above, wherein the upper edges of each of said pin engagement ledges present a curvilinear upper lip edge such that said upper lip edges will cam over said disengagable lock means carried in said coupling when said lock stud is rotated in a clockwise direction and will engage said disengagable lock means when rotated in a counterclockwise direction.

5. The lock mechanism as set forth in claim 4 above, wherein said disengagable lock means carried by said coupling comprises a pair of pins mounted in said coupling and being normally biasingly urged into an extended position, extending into the interior of said coupling for a short distance such that upon the clockwise rotation of said lock stud, said pin engagement ledges will ride over said pins and cam said pins inwardly against the biasing force thereof thereby permitting the free rotation of said lock stud relative to said coupling, whereas the counterclockwise rotation of said lock stud will cause said pins to engage in the pin engagement ledges of said lock stud and lockingly engage said lock stud with said coupling.

6. The lock mechanism as set forth in claim 1 above, wherein said radially curved grasping element carried in said coupling comprises a ball bearing carried in said aperture formed in said coupling.

7. The lock mechanism as set forth in claim 6 above, wherein said coupling includes a plurality of apertures formed therein and being radially and helically displaced, and each of said apertures is provided with a ball bearing carried therein such that said ball bearings together form a plurality of grasping elements for engaging said male threads of said lock stud in radially displaced positions along the length thereof incident to the locking procedure.

8. The lock mechanism as set forth in claim 6 above, wherein said first rotatable tubular sleeve member is provided with a pair of opposed cammed surfaces formed along the posterior end thereof, and said second stationary tubular sleeve member is provided with a corresponding pair of cam surfaces formed along the anterior end thereof such that upon the counterclockwise rotation of said lock stud, said coupling and lock stud will force said first tubular sleeve member to rotate and cam anteriorly relative to said second tubular sleeve member until said expanded diametric interior of said first tubular sleeve member cams into alignment with said reduced diametric throat portion of said coupling thereby to permit said ball bearing to disengage from said male threads of said lock stud and permit a quick release of said lock stud relative to said lock stud receiving mechanism.

9. The lock mechanism as set forth in claim 8 above, wherein said first rotatable tubular sleeve element further includes at least one stop ledge formed thereon adjacent to said cam surface and said second stationary tubular sleeve member includes at least one stop flange positioned adjacent to said stationary cam surface thereof such that upon a 90 degree rotational movement of said first tubular sleeve member relative to said second tubular sleeve member, said stop ledge contacts said stop flange to arrest any further rotational movement as between said elements.

10. The lock mechanism as set forth in claim 9 above, wherein each of said first rotatable tubular sleeve elements and second stationary tubular sleeve elements includes a pair of stop ledges and stop flanges respectively, each one of said pair of stop ledges and stop flanges being positioned on opposed side edges of each of the respective cam surfaces thereof thereby to form two positive stop positions for stopping the rotational movement of said first rotatable tubular sleeve member relative to said second stationary tubular sleeve member upon a 90 degree rotational movement of said first sleeve member relative to said second sleeve member.

11. The lock mechanism as set forth in claim 1 above, wherein said biasing means interposed between said first rotatable tubular sleeve member and said housing comprises a coil spring for normally biasingly urging said first rotatable tubular sleeve member into touching contact with said second stationary tubular sleeve member.

12. The lock mechanism as set forth in claim 11 above, wherein said coupling biasing means interposed between said coupling element and said second stationary tubular sleeve member comprises a coil spring for normally biasingly urging said coupling anteriorly relative to said second stationary tubular sleeve member and positioned within the confines of said first rotatable sleeve member when in the rest position.

13. A locking device for automatically locking a movable closure member relative to a stationary member such as vending machine door and cabinet respectively, comprising;

a lock mechanism of the type provided with a lock stud having a horizontal axis and mounted on the movable closure member, said lock stud having an anterior end and a posterior end, and having a lock handle secured along the anterior end, and the posterior end formed into a nose portion, said lock stud provided with disengagable engagement means formed therein and positioned anteriorly from the posterior nose end thereof, and a series of male threads formed in said lock stud adjacent to and positioned anteriorly of said disengagable engagement means, stud receiving locking means mounted on the stationary member, said stud receiving means formed by a housing enclosed by four side walls and a front wall and a rear wall, each of said front wall and rear wall having an aperture sized to accommodate the insertion therethrough of said lock stud, said housing including lock stud locking means carried therein, said lock stud locking means including a rotatable cam sleeve having an anterior end and a posterior end, and having at least two stepped interior diametric dimensions formed along the horizontal axis thereof with the smallest diametric dimension forming a confinement chamber adjacent the anterior end thereof, and a larger diametric dimension forming a relief chamber posteriorly thereof, and said rotatable cam sleeve further including a pair of circumferentially spaced rotatable cam surfaces formed along the posterior end thereof, a coupling seated within said rotatable cam sleeve, said coupling having at least two stepped throat sections of different diametric dimension with the smallest diametric throat section positioned within said rotatable cam sleeve and adjacent to said anterior end of said housing, said small throat section having at least one aperture formed therein, said aperture provided with a ball bearing seated therein, the larger diametric throat section of said coupling provided with disengagable engagement lock means carried therein and circumferentially spaced apart, said disengagable engagement lock means positioned inwardly toward the interior larger diametric dimensions of said coupling, a stationary cam member seated adjacent said rotatable cam sleeve at the posterior end thereof, said stationary cam member having an inner lip end and an upper spring seat surface, said stationary cam member having a pair of opposed stationary cam surfaces formed along the inner lip end for cammingly engaging the rotatable cam surfaces formed on said rotatable cam sleeve, said stationary cam member including seatment means for seating said member within said housing in a stationary position, a sleeve spring interposed between said rotatable cam sleeve and said front wall of said housing and a coupling spring interposed between said coupling and said upper spring seat surface of said stationary cam member, such that said rotatable cam sleeve and stationary cam member are normally biasingly urged together, whereby upon insertion of said lock stud through the aperture of the front wall of said housing, said lock stud enters said coupling until the ball bearing butts up against the male threads, and upon further exertion of said stud, urges said coupling posteriorly against the pressure of said coupling spring until the ball rides into the larger relief chamber of said rotatable cam sleeve and allows said ball to ride into the male threads such that upon release of the lock stud, said ball retracts once again into said smallest diametric throat section of said rotatable cam sleeve while lockingly engaged in said male threads thereby to lock said lock stud within said housing; and the opening of the lock members is then accomplished by rotating the lock stud counterclockwise until said disengagable engagement lock means in said coupling engage said disengagable engagement means in said lock stud thereby to permit rotation only in a counterclockwise direction and permit the rotatable cam sleeve to cam toward the front wall of the housing until the ball rides into the relief chamber formed by the larger diametric dimension of the rotatable cam sleeve and out of contact with the male thread permitting the lock stud to be fully withdrawn and allow opening of the movable closure member relative to the stationary member.

14. The locking device as set forth in claim 13, wherein said disengagable engagement means formed on said lock stud comprises a pair of opposed pin engagement ledges formed along the horizontal axis of said lock stud and positioned intermediate between said nose end thereof and said male thread portion thereof.

15. The lock mechanism as set forth in claim 14 above, wherein said disengagable engagement lock means formed in the larger throat section of said coupling comprises a pair of spring loaded pins carried by said coupling adapted to be normally biasingly urged into an extended position with said pins extending into the confines of the larger diametric interior dimension of said coupling and said pair of spring loaded pins adapted to engage said pin engagement ledges formed in said lock stud when said lock stud is rotated in a counterclockwise direction thereby to lock said lock stud relative to said coupling when so rotated in a counterclockwise direction.

16. The lock mechanism as set forth in claim 13, wherein said coupling includes a plurality of apertures formed therein and carried in said small throat section of said coupling, each of said apertures adapted to carry a ball bearing seated within the confines thereof, said ball bearings together comprising a plurality of grasping elements adapted to engage and grasp the male threads of said lock stud when said lock stud is lockingly inserted within the confines of said stud receiving locking means.

17. The lock mechanism as set forth in claim 16 above, wherein said plurality of apertures are positioned in radially and helically displaced orientation, such helical displacement corresponding to the helical displacement of said male threads formed on said lock stud, such that when said ball bearings are in the confinement chamber of said first rotatable cam sleeve, said lock stud may be rotated in a clockwise and counterclockwise direction and said ball bearings will helically mate with the helical configuration of said male threads thereby to permit the threading rotational movement of said lock stud therein.

18. The lock mechanism as set forth in claim 13 above, wherein said housing further includes at least one seatment slot formed therein, and said stationary cam sleeve includes at least one seating tab.

19. The lock mechanism as defined in claim 13 above, wherein said coupling further includes an alignment flange formed therein along the horizontal axis thereof and extending slightly outwardly therefrom, and said rotatable cam sleeve includes an alignment slot formed therein along the horizontal axis therein, said alignment flange of said coupling being adapted to seat within said alignment slot of said rotatable cam sleeve thereby to prevent any rotational movement of said coupling relative to said rotational cam sleeve during the operation of said lock mechanism, while nevertheless, permitting the reciprocating movement of said coupling relative to said rotational cam sleeve.

* * * * *